US006806645B2

(12) United States Patent
Choi

(10) Patent No.: US 6,806,645 B2
(45) Date of Patent: Oct. 19, 2004

(54) PLASMA DISPLAY PANEL

(75) Inventor: Kwang Yeol Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/274,972

(22) Filed: Oct. 22, 2002

(65) Prior Publication Data

US 2003/0076037 A1 Apr. 24, 2003

(30) Foreign Application Priority Data

Oct. 24, 2001 (KR) ..... 2001-65737
Nov. 1, 2001 (KR) ..... 2001-67777

(51) Int. Cl.[7] ..... H01J 17/49
(52) U.S. Cl. ..... 313/582; 313/584
(58) Field of Search ..... 313/582, 583, 313/584, 585, 586

(56) References Cited

U.S. PATENT DOCUMENTS 6,522,075 B2 * 2/2003 Koshio et al. ..... 313/586
6,661,170 B2 * 12/2003 Amemiya ..... 313/582

* cited by examiner

*Primary Examiner*—Vip Patel
(74) *Attorney, Agent, or Firm*—Fleshner & Kim, LLP

(57) ABSTRACT

A plasma display panel is provided which reduces power consumption requirements and improves discharge efficiency. Transparent electrodes are formed so as to extend to a center portion of neighboring discharge cells, and perpendicular to projection electrodes formed along the barrier ribs to enhance discharge efficiency. A pair of wings formed on the ends of the transparent electrodes further improves discharge efficiency, while scan and projection electrodes are formed along a portion of the barrier ribs to enhance brightness.

36 Claims, 10 Drawing Sheets

PLASMA DISPLAY PANEL

BACKGROUND OF THE INVENTION

1. Field of the Invention

The present invention relates to a plasma display panel, and more particularly, to a plasma display panel to require a low power consumption and improve discharge efficiency.

2. Background of the Prior Art

In recent years, there are being actively developed flat panel displays such as Liquid Crystal Display (LCD), Field Emission Display (FED) and Plasma Display Panel (PDP).

PDP displays letter or image including graphic while phosphors emit light by means of ultraviolet rays having wavelength of 147 nm generated during discharge of inert mixture gas such as He+Xe or Ne+Xe. These PDPs have advantages in that they are easily made in a thin and large-sized structure. In addition, since the PDPs have a simplified structure, it is easy to fabricate them. Further, the PDPs have advantages in that they are higher in brightness and light emission efficiency than other flat panel displays. Owing to the above advantages, researches for the PDP are being actively carried out.

Especially, in the three-electrode AC surface discharge type PDP, wall charges are accumulated on the surfaces of the electrodes during discharge and the electrodes are protected from the sputtering that is generated by discharge. So, the three-electrode AC surface discharge type PDP has low voltage driving and long life characteristics.

FIGS. 1 and 2 illustrate the structures of the barrier ribs in the conventional PDPs. Specifically, FIG. 1 shows a stripe type barrier rib structure and FIG. 2 shows a wall type barrier rib structure.

Referring to FIGS. 1 and 2, the PDP has a pair of electrodes, e.g., scan electrodes 12Y and sustain electrodes 12Z, formed on a front substrate 10, and an address electrode formed on a rear substrate 18.

Each of the scan electrodes 12Y and the sustain electrodes 12Z is made of transparent electrode material (Indium Tin Oxide: hereinafter referred to as ITO) to transmit visible light, and includes a transparent electrode 12*a* and a bus electrode 12*b*. The transparent electrode 12*a* is larger in area than the bus electrode 12*b*. The bus electrode 12*b* compensates for the resistance of the transparent electrode 12*a*. A scan signal for scanning a panel and a sustain signal for sustaining discharge are mainly applied to the scan electrodes 12Y, and sustain signal is applied to the sustain electrodes 12Z.

A front dielectric layer 14 and a protective layer 16 are successively laminated on the electrodes 12Y and 12Z formed on the front substrate 10. On the front dielectric layer 14 is accumulated the wall charge generated during plasma discharge. The protective layer 16 protects the front dielectric layer 14 from damages caused by sputtering during plasma discharge and also enhances the emission efficiency of the secondary electrons. The protective layer 16 is usually made of magnesium oxide (MgO).

The address electrodes 12X are formed to cross over the electrodes 12Y and 12Z and are provided with data signals to select discharge cells for display images. A rear dielectric layer 22 is formed on the address electrodes 12X. Barrier ribs 24*a* and 24*b* are formed on the rear dielectric layer 22 in parallel with the address electrodes 12X.

A phosphor layer 26 is coated on the surfaces of the rear dielectric layer 22 and the barrier ribs 24*a* and 24*b*. The phosphor layer 26 is excited by the ultraviolet rays generated during the plasma discharge to generate one of visible rays of red, green and blue colors. The inert gas for discharge is injected into discharge spaces prepared between the front substrate 10/the rear substrate 18 and the barrier ribs 24*a* and 24*b*. The barrier ribs 24*a* and 24*b* are formed in parallel with the address electrodes 12X to prevent the ultraviolet rays and the visible rays generated by discharge from leaking into the neighboring discharge cells.

In general, a PDP has an efficiency of 11 m/W, brightness of 400 cd/m$^2$ and power consumption of 300 W. Usually, the PDP for home television (TV) needs to improve the brightness and reduce the power consumption. To meet these requirements, the light emission efficiency of panel should be improved.

The light emission efficiency of a PDP is expressed as the following equation 1:

$$\eta = \frac{\pi BS}{P}, \qquad \text{Equation 1}$$

where B is brightness, S is the area of light emission and P is power consumption.

As expressed in the equation 1, the light emission efficiency is proportional to the brightness B and the area of light emission S but inversely proportional to the power consumption P. Accordingly, to improve the light emission efficiency of the PDP, it is required to elevate the brightness B and reduce the power consumption P.

Until now, the stripe type barrier rib (depicted in FIG. 1) and the wall type barrier rib (depicted in FIG. 2) were described.

The stripe type barrier rib 24*a* separates the discharge cells in a stripe fashion. The phosphors formed in the discharge cells separated in this manner are arranged in a successive configuration of red, blue and green. Each of the discharge cells separated by the stripe type barrier ribs 24*a* has a ratio of horizontal length to vertical length of 1:3. Since the horizontal length is shorter than the vertical length, the discharge space is reduced and so the discharge efficiency is lowered. In other words, the stripe type barrier rib 24*a* is useful to gas evacuation but its light emission efficiency is low due to the small covering area of the phosphors. Also, in the stripe type barrier rib 24*a*, the visible light is not effectively emitted to the outside of the discharge cell since the occupying area of the phosphors 26 formed on the lower portions of the discharge cells is small.

To overcome the above-described problem, there is proposed a wall type barrier rib 24*b* in which the shape of discharge cells substantially approaches the square. While this wall type barrier rib 24*b* enlarges the coated area of the phosphors 26 to elevate the brightness, it has a problem in that the gas evacuation is not easy. To overcome this problem, there is suggested is the PDP having delta type barrier ribs illustrated in FIGS. 3 and 4.

Referring to FIGS. 3 and 4, a discharge cell of the PDP having delta type barrier ribs 24*c* includes electrodes 12Y and 12Z formed on a front substrate 10 and an address electrode 12X formed on a rear substrate 18. The delta type barrier rib 24*c* is formed on the rear substrate 18 on which the address electrode 12X is formed, and has discharge cells each surrounded by six faces to form a connection structure of narrow channels 34. The channel 34 makes gas evacuation and gas injection easy.

Each of the electrodes 12Y and 12Z have a transparent electrode 12*a* made of ITO that has good transparency and a metal electrode 12*b* to lower the high resistance of the transparent electrode 12*a*. These electrodes 12Z and 12Y are arranged symmetrically at all discharge cells, and so the metal electrode 12*b* is located at the center of the transparent electrode 12*a* unlike the discharge cells of the stripe type barrier ribs and the wall type barrier ribs. Since the metal electrode 12*b* shields the light that is incident into the discharge cell, the brightness is reduced depending on the shielded light amount. In addition, the delta type barrier rib 24*c* makes it difficult to secure the discharge space due to a tendency toward the high definition of the PDP, so that the discharge efficiency is reduced. Also, since the discharge area of the transport electrode 12*a* relates to discharge voltage, the increase of the discharge area causes the discharge voltage necessary for discharge to be increased. As a result, the power consumption is increased and thus the light emission efficiency is lowered. To this end, it is strongly required to reduce the discharge area and maximize the discharge efficiency.

SUMMARY OF THE INVENTION

An object of the invention is to solve at least the above problems and/or disadvantages and to provide at least the advantages described hereinafter.

Accordingly, the present invention is to provide a plasma display panel for forming the transparent electrodes in the direction of a long axis of barrier ribs.

These and other objects and advantages of the invention are achieved by providing a plasma display panel which includes: delta type barrier ribs formed on a rear substrate; scan electrode lines and sustain electrode lines formed on a front substrate in a long axis direction of the delta type barrier ribs; first projection electrodes formed to project from the scan electrode lines alternatively in both directions perpendicular to the scan electrode lines; second projection electrodes formed to project from the sustain electrode lines alternatively and facing the first projection electrodes; first transparent electrodes perpendicularly connected to the first projection electrodes and formed over the neighboring discharge cells of the delta type barrier ribs; second transparent electrodes connected to the second projection electrodes perpendicularly and formed over the neighboring discharge cells of the delta type barrier ribs; and address electrodes formed on a rear substrate in parallel with the first transparent electrodes and the second transparent electrodes and larger at the discharge cells than at the delta type barrier ribs.

It is desired that the first transparent electrodes and the second transparent electrodes include a pair of wings that extend in a short axis direction of the delta type barrier ribs at ends thereof.

It is desired that the first transparent electrodes and the second transparent electrodes include a pair of wings extending in a short axis direction of the delta type barrier ribs at ends thereof; and a center wing extending in the direction of the short axis of the delta type barrier ribs at position facing the delta type barrier ribs.

It is desired that the first transparent electrodes and the second transparent electrodes are formed in the form of a rectangular having a plurality of rectangular or ellipse holes.

According to another aspect of the present invention, a plasma display panel includes: delta type barrier ribs formed on a rear substrate; scan electrode lines and sustain electrode lines formed on a front substrate in a direction of a long axis of the delta type barrier ribs; first projection electrodes formed to project from the scan electrode lines alternatively in both directions perpendicular to the scan electrode lines; second projection electrodes formed to project from the sustain electrode lines alternatively and facing the first projection electrodes; first and second transparent electrodes respectively and perpendicularly connected to the first and second projection electrodes and formed in the form of a rectangular extending to the neighboring discharge cells around the delta type barrier ribs; and address electrodes formed on the rear substrate in parallel with the first transparent electrodes and the second transparent electrodes with an area larger at the discharge cells than at the delta type barrier ribs.

According to further aspect of the present invention, a plasma display panel includes: delta type barrier ribs formed on a rear substrate; scan electrode lines and sustain electrode lines formed on a front substrate in a direction of a long axis of the delta type barrier ribs; first projection electrodes formed to project from the scan electrode lines alternatively in both directions perpendicular to the scan electrode lines; second projection electrodes formed to project from the sustain electrode lines alternatively and facing the first projection electrodes; first and second transparent electrodes respectively and perpendicularly connected to the first and second projection electrodes, including a pair of wings extending in a direction of a short axis of the delta type barrier ribs at ends thereof, and formed extending to the neighboring discharge cells around the delta type barrier ribs; and address electrodes formed on the rear substrate in parallel with the first transparent electrodes and the second transparent electrodes with an area larger at the discharge cells than at the delta type barrier ribs.

According to still aspect of the present invention, a plasma display panel includes: delta type barrier ribs formed on a rear substrate; scan electrode lines and sustain electrode lines formed on a front substrate in a direction of a long axis of the delta type barrier ribs; first projection electrodes formed to project from the scan electrode lines alternatively in both directions perpendicular to the scan electrode lines; second projection electrodes formed to project from the sustain electrode lines alternatively and facing the first projection electrodes; first and second transparent electrodes respectively and perpendicularly connected to the first and second projection electrodes, including a pair of wings extending in a direction of a short axis of the delta type barrier ribs at ends thereof and a center wing extending in the direction of the short axis of the delta type barrier ribs at position facing the delta type barrier ribs, and formed extending to the neighboring discharge cells around the delta type barrier ribs; and address electrodes formed on the rear substrate in parallel with the first transparent electrodes and the second transparent electrodes and larger at the discharge cells than at the delta type barrier ribs.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The following detailed description will present a preferred embodiment of the invention in reference to the accompanying drawings.

DETAILED DESCRIPTION OF THE PREFERRED EMBODIMENTS

Reference will now be made in detail to a preferred embodiment of the present invention.

Figure 1:
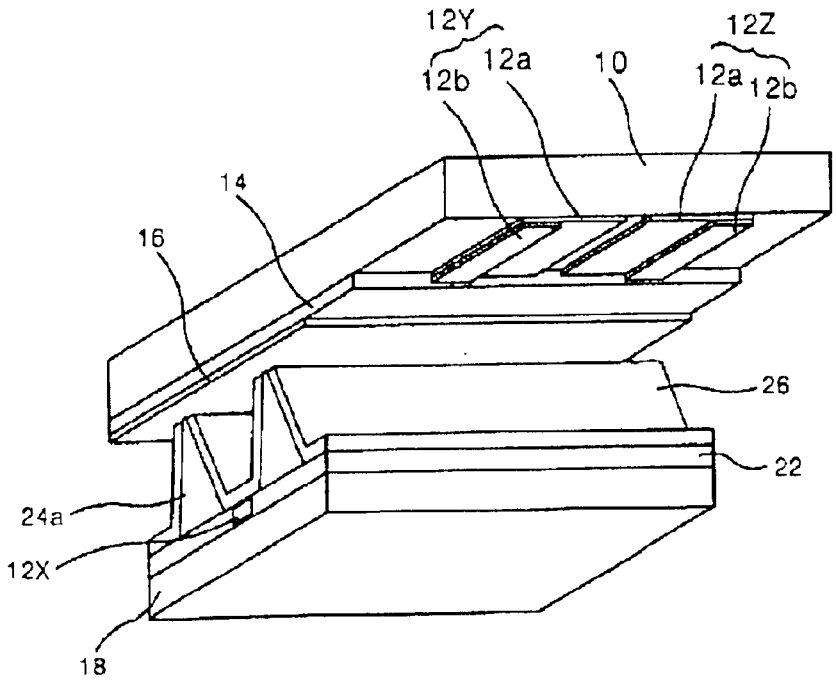
Fig. 1(Related Art)
FIG. 1 is an exploded perspective view of a PDP having stripe type barrier ribs the conventional art.
Figure 2:
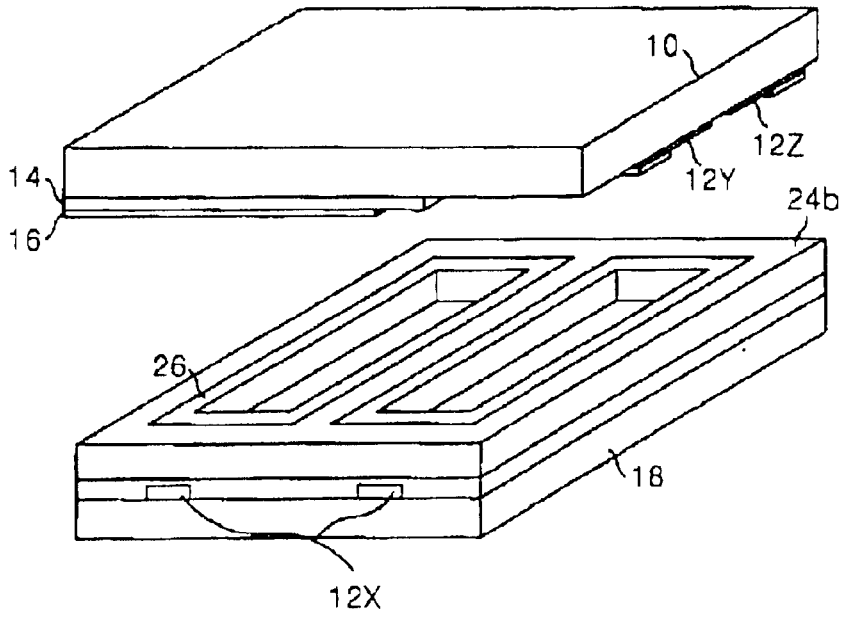
Fig. 2(Related Art)
FIG. 2 is an exploded perspective view of a PDP having wall type barrier ribs the conventional art.
Figure 3:
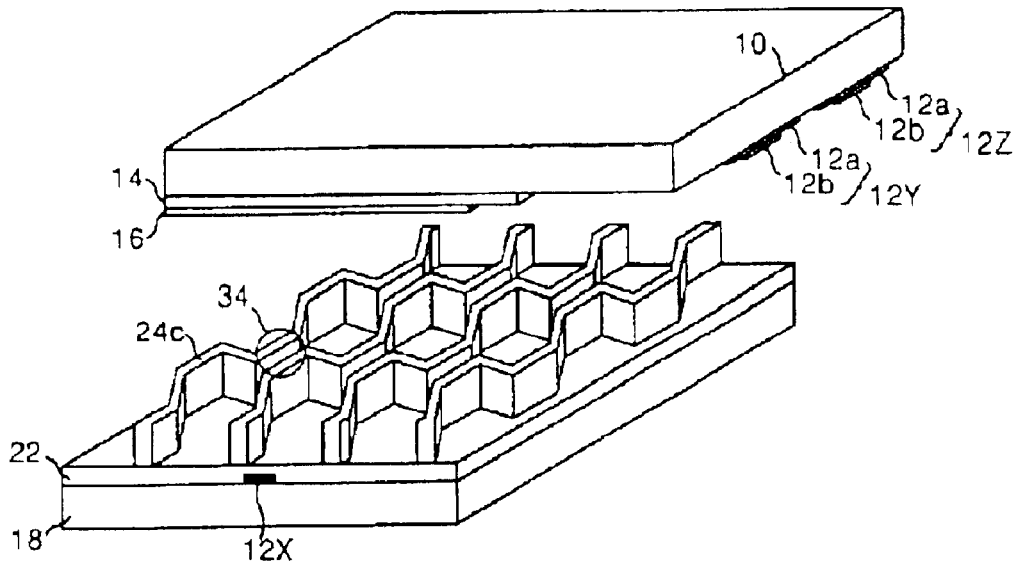
Fig. 3(Related Art)
FIG. 3 is an exploded perspective view of a PDP having delta type barrier ribs the conventional art.
Figure 4:
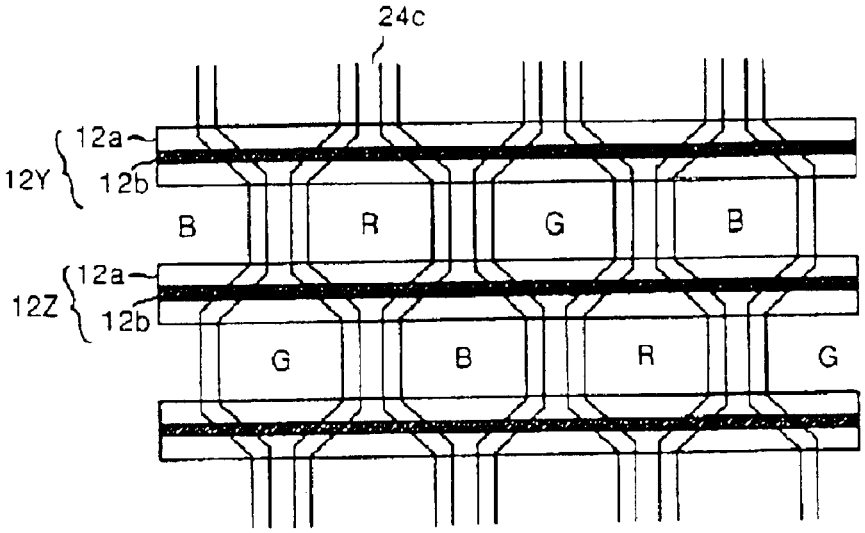
Fig. 4(Related Art)
FIG. 4 illustrates the electrodes of the PDP shown in FIG. 3.
Figure 5:
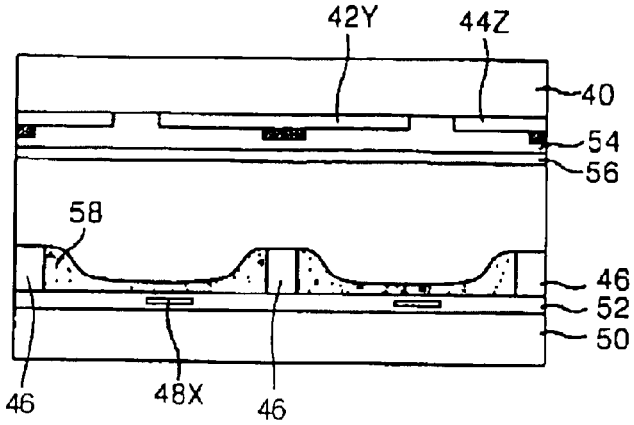
FIG. 5 is a cross sectional view of a PDP according to the first preferred of the present invention.
Figure 6:
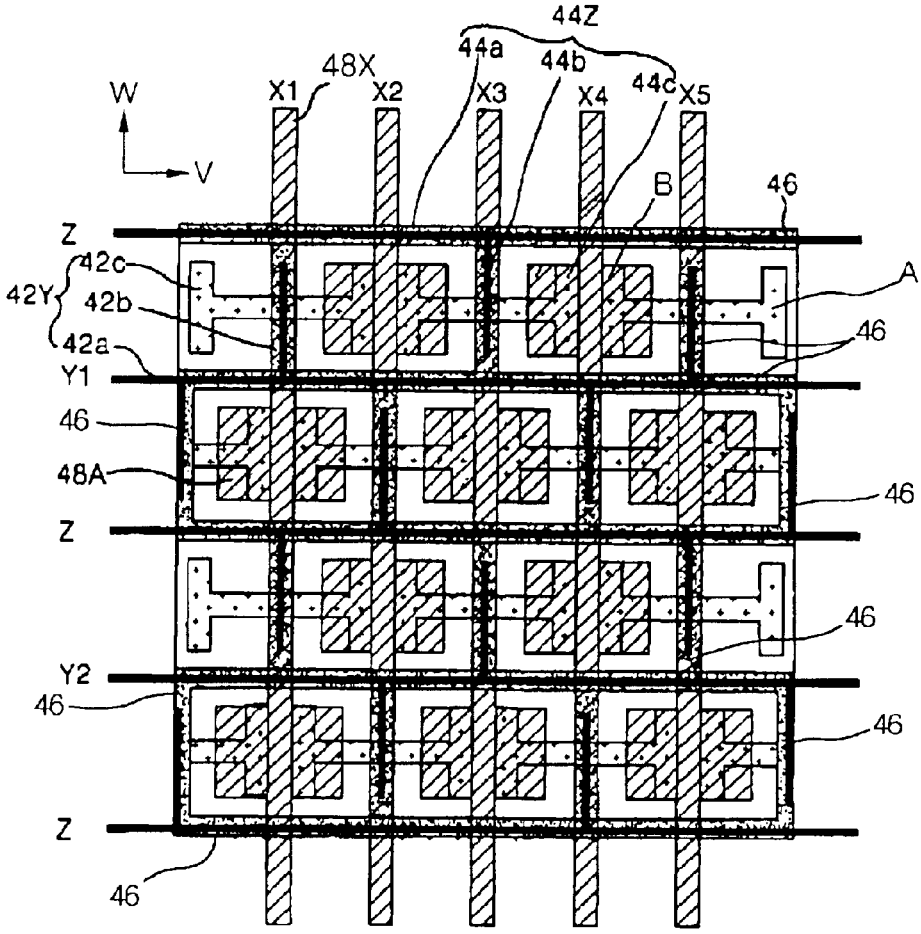
FIG. 6 illustrates the electrodes of the PDP shown in FIG. 5.
Figure 7:
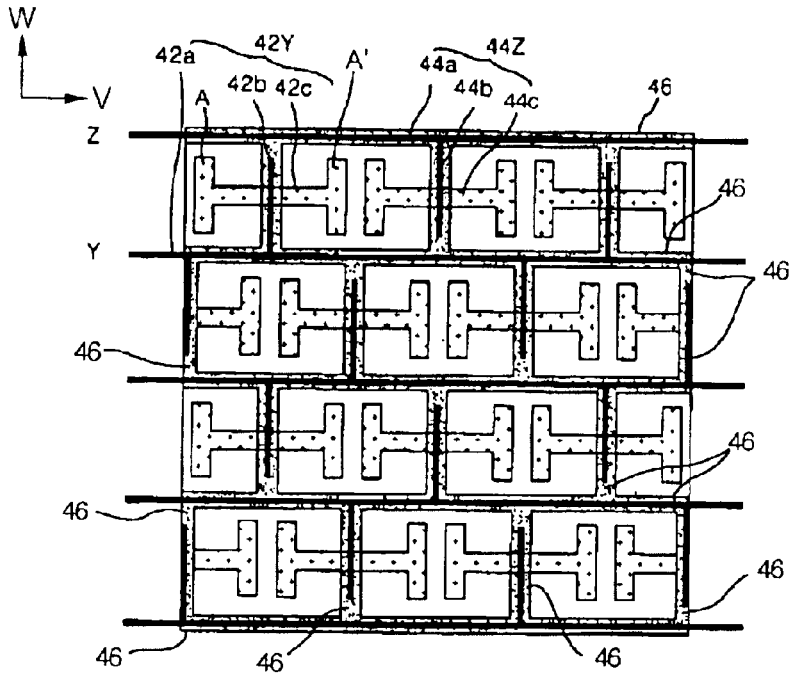
FIG. 7 illustrates the electrodes of the front substrate of the PDP shown in FIG. 5.

FIG. 5 is a cross sectional view of a PDP according to the first preferred embodiment of the present invention. FIG. 6 illustrates the electrodes of the PDP shown in FIG. 5. FIG. 7 illustrates the electrodes of the front substrate and the rear substrate of the PDP shown in FIG. 5 respectively.

Referring to FIGS. 5 through 8, a PDP according to the first embodiment of the invention has scan electrodes 42Y and sustain electrodes 44Z on a front substrate 40 and address electrodes 48X and delta type barrier ribs 46 on a rear substrate 50.

Each of the scan electrodes 42Y includes a scan electrode line 42*a*, a first projection electrode 42*b* and a first transparent electrode 42*c* as shown in FIG. 7. More concretely, the scan electrode 42Y has the scan electrode line 42*a* formed along the delta type barrier rib 46, the first projection electrode 42*b* projecting alternatively from the scan electrode line 42*a* in both directions perpendicular to the scan electrode line 42*a*, and the first transparent electrode 42*c* connected to the first projection electrode 42*b* and formed extending to the neighboring discharge cells around the delta type barrier rib 46.

The scan electrode lines 42*a* are arranged in parallel with a direction V that is the long axis direction of the delta type barrier ribs. The first projection electrodes 42*b* project from the scan electrode lines 42*a* alternatively in both directions perpendicular to the scan electrode lines 42*a* and are equally spaced from the neighboring first projection electrodes 42*b*. In this case, it is desirable that the first projection electrodes 42*b* are formed along the delta type barrier ribs 46.

The delta type barrier ribs are rectangular and arranged so as to form a rectangular discharge cell. Hence, by using the rectangular structure and arrangement of the delta type barrier ribs, the scan electrode lines and the first projection electrodes can be formed along the delta barrier ribs. The reason why the scan electrode lines and the first projection electrodes which are made of metal are formed along the delta type barrier ribs is to allow the ultraviolet rays generated by the discharge cells to be transmitted to the outside of the discharge cell as much as possible. In other words, since the scan electrode lines and the first projection electrodes are not-located in the discharge cells, the ultraviolet rays generated by the discharge can be transmitted to the outside of the discharge cell without any hindrance.

The first transparent electrodes 42*c* are connected to the first projection electrodes 42*b* and extend in both directions perpendicular to the first projection electrodes 42*b*. In other words, the first transparent electrodes 42*c* are formed extending to the neighboring discharge cells divided by the delta type barrier ribs 46. In this case, both ends of each of the first transparent electrodes 42*c* are provided with both wings A and A' that extend in a direction W that is the short axis direction of the delta type barrier ribs.

Ultimately, the transparent electrodes 42*c* are formed to be orthogonal to the first projection electrodes 42*c*. Accordingly, the scan electrode lines 42*a* and the first projection electrodes 42*b* are formed along the delta type barrier ribs 46. The transparent electrodes 42*c* are formed orthogonal to the second projection electrodes and thus are arranged extending to the neighboring discharge cells, On the other hand, each of the sustain electrodes 44Z includes a sustain electrode line 44*a*, a second projection electrode 44*b* and a second transparent electrode 44*c* as shown in FIG. 7. In this case, the sustain electrodes 44Z is the same as the scan electrode 42Y in their structure.

In other words, the sustain electrodes 44Z are arranged in parallel with the direction V that is the long axis direction of the delta type barrier ribs 46. The second projection electrodes 44*b* project from the sustain electrode lines alternatively in both directions perpendicular to the sustain electrode lines. The second transparent electrodes 44*c* are perpendicularly connected to the second projection electrodes 44*b* perpendicularly to be formed extending to the neighboring discharge cells. Of course, each of the second transparent electrodes 44*c* is provided at both ends thereof with both wings A and A' that are comparatively large in area.

Reviewing the above structure of the PDP according to the first preferred embodiment of the present invention, when the scan electrode line 42*a* is formed in one delta type barrier rib, a sustain electrode line is formed in the other delta type barrier rib that is facing to the delta type barrier rib. Also, the first projection electrode 42*b* and the second projection electrode 44*b* are respectively arranged on the delta type barrier ribs located on the left and right sides of the scan electrode line 42*a* and the sustain electrode line 44*a*. In this case, the first transparent electrode line 42*c* projects to the middle of the discharge cell T and symmetrically the second transparent electrode line 44*c* projects to the middle of the discharge cell T.

The scan electrode lines 42*a*, the sustain electrode line 44*a*, the first projection electrode 42*b* and the second projection electrode 44*b* have comparatively narrow widths and are made of one of copper (Cu), chrome (Cr) and silver (Ag).

As described above, since the first transparent electrodes 42*c* and the second transparent electrodes 44*c* have the narrower width than those of the conventional art, the discharge area is decreased, so that and the power consumption is reduced. The both wings A and A' are formed comparatively larger, so that the discharge efficiency is improved. It is desired that the first transparent electrodes 42*c* and the second transparent electrodes 44*c* should be made of ITO having good transmittance of visible light.

The scan electrodes 42Y receive scan signals for scanning a panel and sustain signals for sustaining discharge, and the sustain electrodes 44Z mainly receive sustain signals.

On the other hand, a front dielectric layer 54 and a protective layer 56 are sequentially formed on the scan electrodes 42Y and the sustain electrodes 44Z. The front dielectric layer 54 accumulates the wall charge generated during plasma discharge. The protective layer 56 protects the front dielectric layer 54 from the damage caused by sputtering during the plasma discharge, and also enhances the second electrons emission efficiency. The protective layer 56 is usually made of magnesium oxide (MgO).

Figure 8:
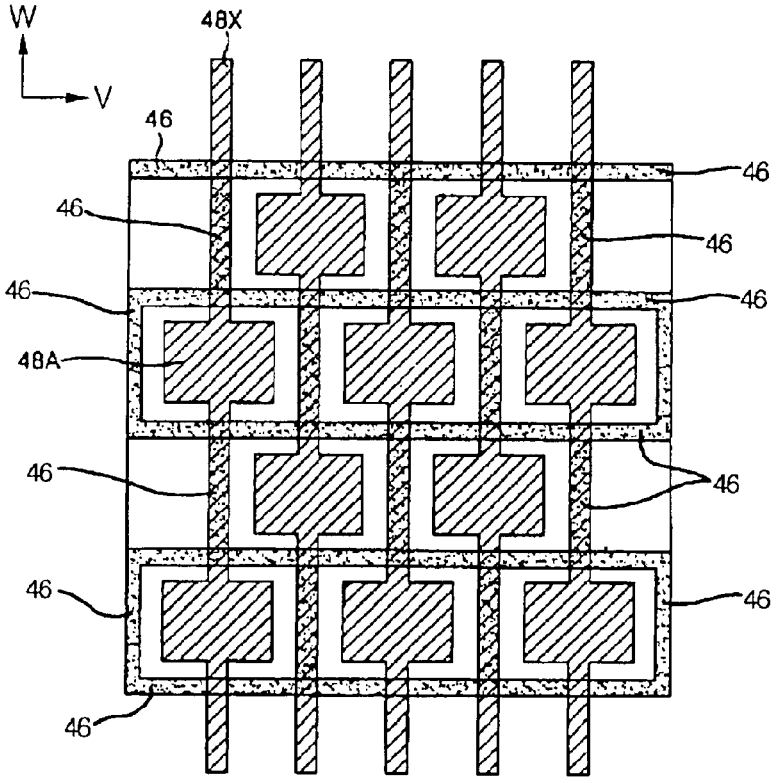
FIG. 8 illustrates the electrodes of the rear substrate of the PDP shown in FIG. 5.

The address electrodes 48X are formed on the rear substrate 50 in parallel with the first projection electrodes 42Y and the second projection electrodes 44*b*, and are formed larger on the discharge cells than on the delta type barrier ribs 48A as shown in FIG. 8. The address electrodes 48X cross over the scan electrodes 42Y and the sustain electrodes 44Z, and receive data signals for selecting discharge cells to display.

A rear dielectric layer 52 is formed on the address electrodes 48X. The delta type barrier ribs 46 to divide discharge cells are formed on the rear dielectric layer 52. The delta type barrier ribs 46 are formed in parallel with the address electrodes 48X and prevent the ultraviolet rays and the visible rays generated by discharge from leaking into the neighboring discharge cells.

A phosphor 58 is formed on the rear dielectric layer 52 and the delta type barrier ribs 46. The phosphor 58 is excited by the ultraviolet rays generated during plasma discharge to generate one of visible rays of red, green and blue colors.

Figure 9:
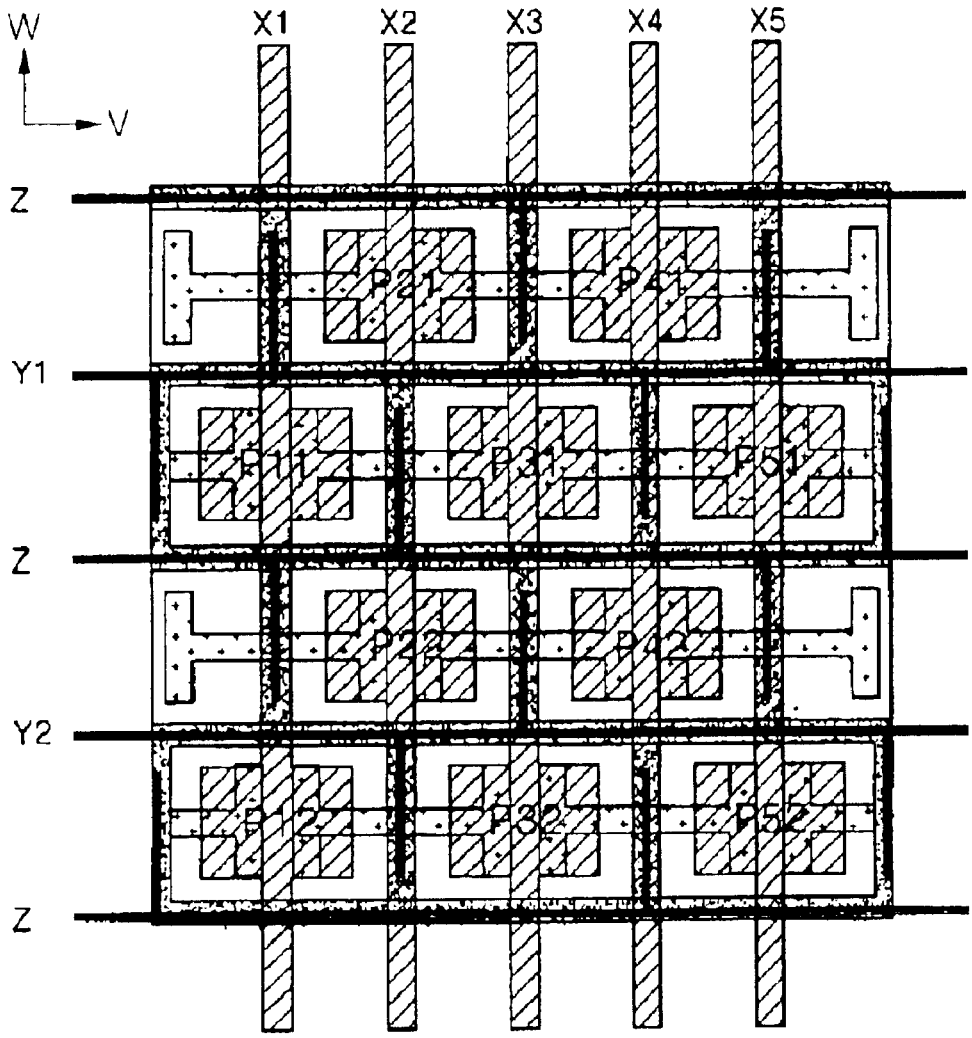
FIG. 9 illustrates a method to drive the PDP shown in FIG. 5.

Next, the structure of the electrodes of the PDP according to the first embodiment of the present invention is reviewed. As scan pulses SP and data pulses DP are applied to the scan electrodes 42Y and the address electrodes 48X respectively during addressing, address discharge is generated. In this case, since the width of the address electrodes 48X increases at the discharge cell portion, the wall charge generated during the address discharge increases. This may lower the address voltage that is necessary for the address discharge. The wall charge generated during the address discharge is sustained while the other discharge cells are addressed. For example, when scan pulses SP are applied to the first scan electrodes Y1 during addressing as shown in FIG. 9, the data pulses DP applied to the first address electrode X1 cause discharge in a first discharge cell P11. Similarly, when scan pulses SP are applied to the second scan electrodes Y2 during addressing, the data pulses DP applied to the second address electrode X2 cause discharge in a second discharge cell P22. In this manner, one discharge cell is selected by address discharge during addressing The sustain discharge is generated between the corresponding scan electrode and the sustain electrode in the discharge cell selected by the address discharge. In other words, if the discharge voltage is applied to the scan electrode line and the sustain electrode line, it is applied to the first transparent electrode and the second electrode via the first projection electrode and second projection electrode. This generates sustain discharge between the first transparent electrode and the second transparent electrode. In this case, discharge gas is excited in a discharge space to generate ultraviolet rays during transition. The ultraviolet rays excite the phosphor to emit visible rays to the outside.

The discharge cells with the delta type barrier ribs have a ratio of the length of the long axis to the length of the short axis of 4:3 while the discharge cells with stripe type barrier ribs has a ratio of 3:1. Even though the visible rays generated by a rear phosphor collide with the barrier ribs, the visible rays are transmitted to the outside without any leak to improve the usage efficiency of the visible rays and the discharge efficiency. In general, the longer the discharge electrodes are, the more the discharge efficiency is.

In the conventional art, the discharge cells with the delta type barrier ribs discharge in the direction of the short axis but has a limitation in lengthening the discharge electrodes in the direction of the short axis. In the discharge cells with the delta type barrier ribs as shown in the first embodiment of the present invention, the discharge electrodes, that is, the transparent electrodes are formed extending to the middle of the discharge cells, so that the sustain discharge is generated in the direction of the long axis and thus the discharge efficiency is enhanced. In the other hand, the first transparent electrode 42*c* and the second transparent electrode 44*c* may have the center wings B that extend in the direction W that is the short axis at the location facing the delta type barrier ribs which the first projection electrode 42*b* and the second projection electrode 44*b* are located on. This structure is described with reference to FIG. 10.

Figure 10:
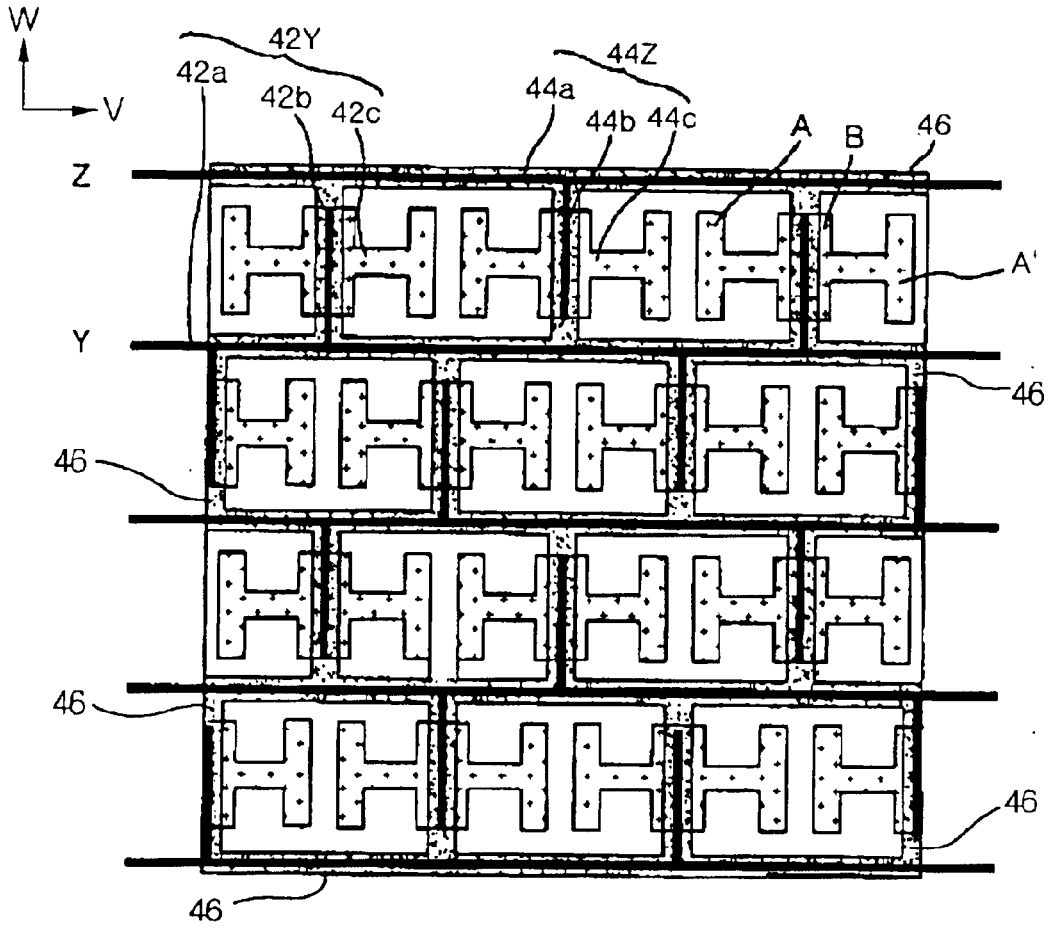
FIG. 10 illustrates the electrodes of a PDP according to the second preferred of the present invention.

FIG. 10 illustrates the electrodes of a PDP according to the second preferred embodiment of the present invention. In the electrodes of a PDP according to the second preferred embodiment of the present invention, a scan electrode line 42*a*, a sustain electrode line 44*a*, a first projection electrode 42*b* and a second projection electrode 44*b* are the same in their structure as the electrodes of the PDP according to the first preferred embodiment of the present invention described above but a first transparent electrode 42*c* and a second electrode 44*c* are different from those of the first embodiment of the present invention. Hence, only the differences are described herein.

The first transparent electrode 42*c* and the second electrode 44*c* include a pair of the wings A and A' extending in the direction W that is the short axis of the delta type barrier ribs 46 at their ends and the center wings extending in the direction W of the short axis of the delta type barrier ribs 46 at the location facing the delta type barrier ribs 46. In other words, the first transparent electrodes 42*c* and the second transparent electrodes 44*c* according to the second embodiment of the present invention are different from those of the first embodiment of the present invention in their structure because the first transparent electrodes 42*c* and the second transparent electrodes 44*c* according to the second embodiment of the present invention further include the center wings B. And thus, the pair of the wings A and A' and the center wings B of the first transparent electrodes 42*c* and the second transparent electrodes 44*c* according to the second embodiment of the present invention are larger than other portions in their electrode areas.

The center wings B help the discharge triggered at the pair of wings A and A' to be effectively maintained in the discharge cells. In other words, the discharge caused by the pair of the wings located on the discharge cell occurs in the direction V that is the long axis of the delta type barrier ribs. At this time, the center wings B cause discharge so widely in the direction of the short axis that the discharge occurs very effectively.

Figure 11:
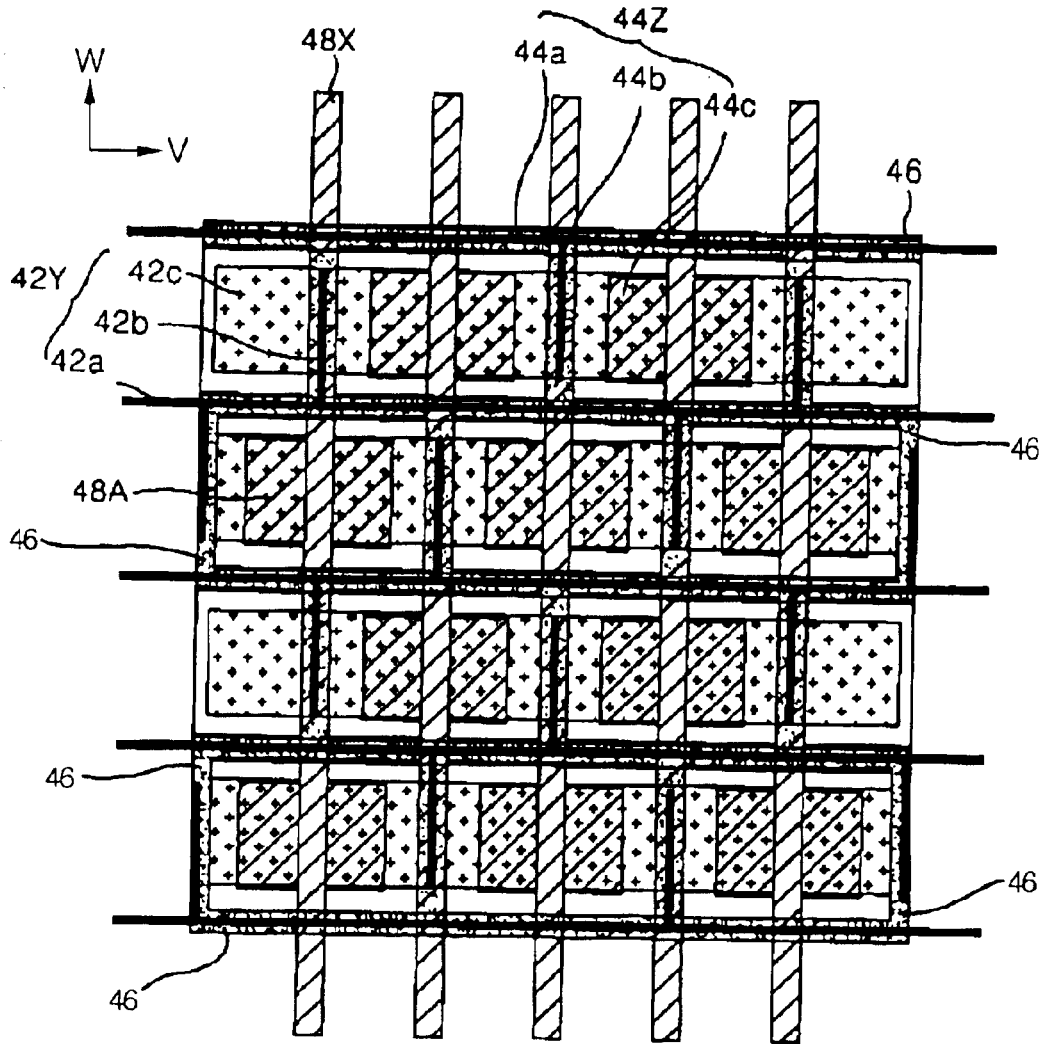
FIG. 11 illustrates the electrodes of a PDP according to the third preferred of the present invention.
Figure 12:
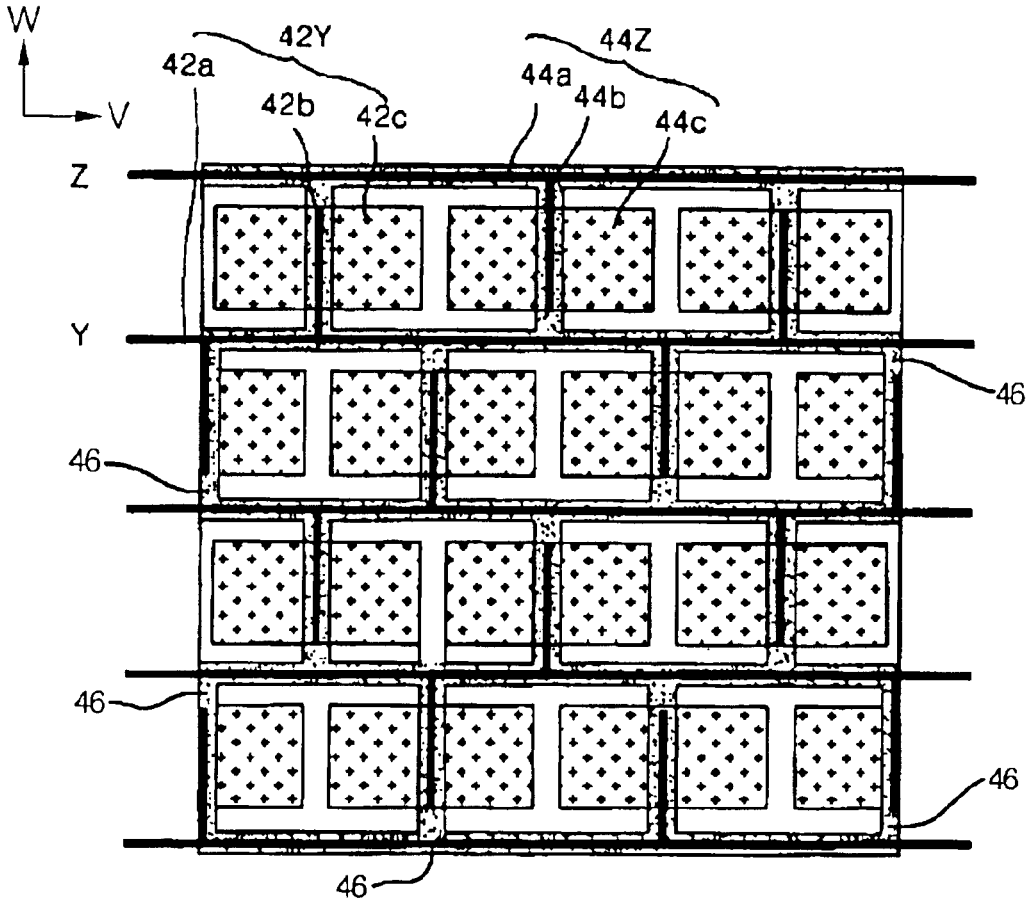
FIG. 12 illustrates the electrodes of the front substrate of the PDP shown in FIG. 11.

On the other hand, the first and second transparent electrodes 42*c* and 44*c* can be formed to have large area in a rectangular shape as shown in FIGS. 11 and 12. FIG. 11 illustrates the electrodes of a PDP according to the third preferred embodiment of the present invention. FIG. 12 illustrates the electrodes of the front substrate of the PDP shown in FIG. 11.

Reviewing the structure of the electrodes of a PDP according to the third preferred embodiment of the present invention, the first transparent electrodes 42*c* and the second electrodes 44*c* are connected to the first projection electrodes 42*b* and the second projection electrodes 44*b* respectively and formed largely extending to the neighboring discharge cells of the delta type barrier ribs 46 in rectangular shape. It is desired that the first transparent electrodes 42*c* and the second transparent electrodes 44*c* are formed as large as possible so that the areas of the first transparent electrodes 42*c* and the second transparent electrodes 44*c* are substantially the same as the area of the discharge cells. In the structure of the electrodes of the PDP according to the third preferred embodiment of the present invention, the transparent electrodes are formed in the direction of the long axis to improve discharge efficiency. However, the transparent electrodes are so large that the almost all visible rays transmit through the transparent electrodes, which reduces the brightness. The structure of the electrodes of a PDP to overcome this problem is depicted in FIGS. 13 and 14.

Figure 13:
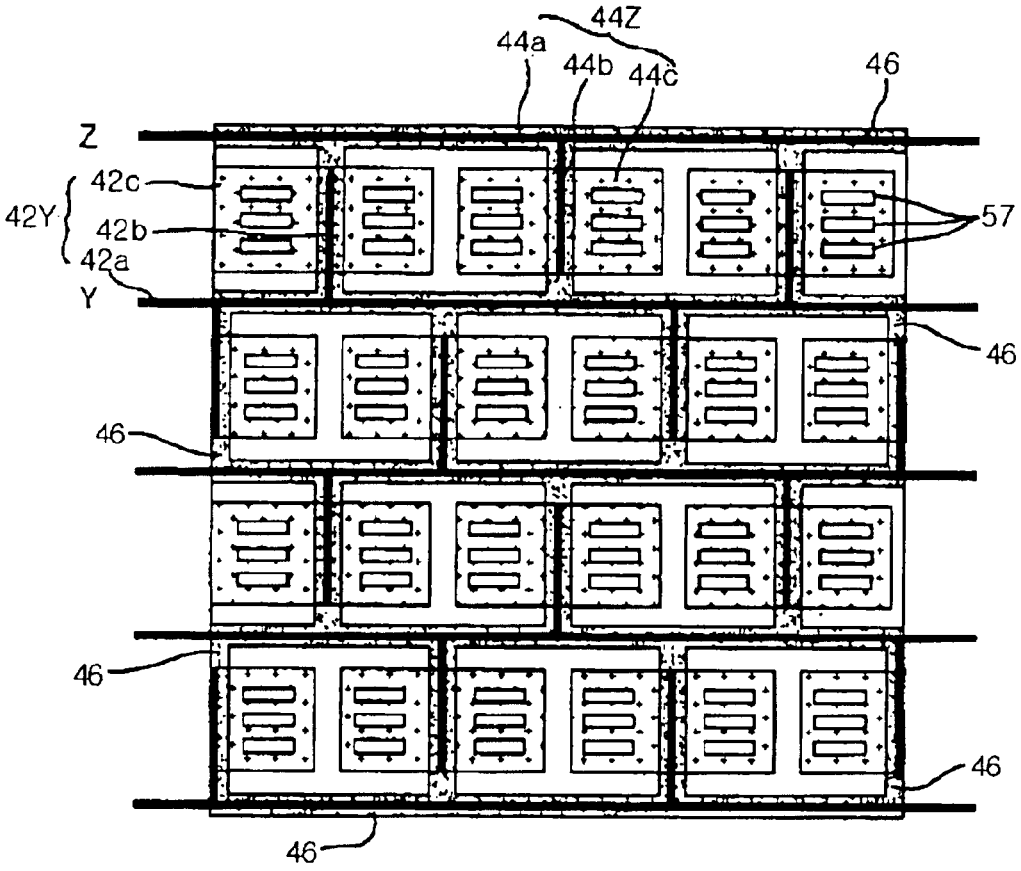
FIG. 13 illustrates the electrodes of a PDP according to the fourth preferred embodiment of the present invention.

As shown in FIG. 13, the first transparent electrodes 42*c* and the second transparent electrodes 44*c* of the PDP according to the fourth preferred embodiment of the present invention are provided with a plurality of rectangular holes 57.

Figure 14:
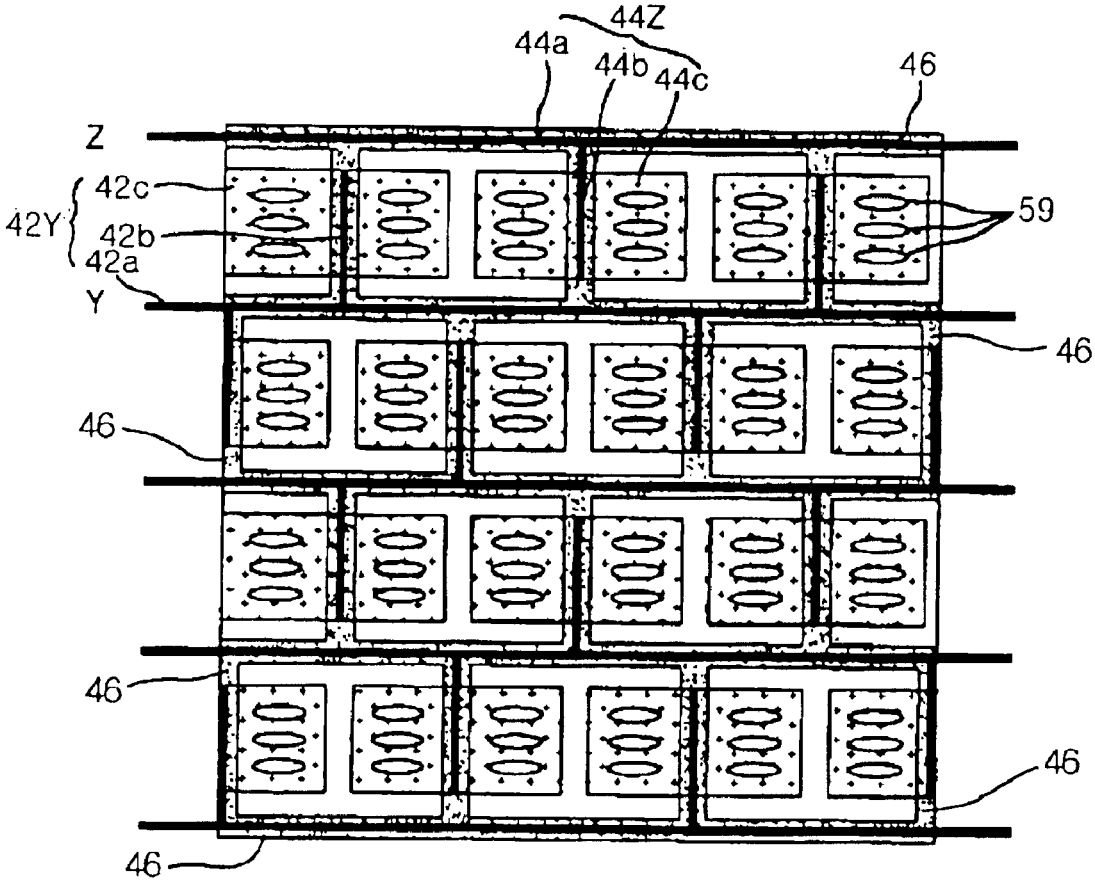
FIG. 14 illustrates the electrodes of a PDP according to the fifth preferred embodiment of the present invention.

As shown in FIG. 14, the first transparent electrodes 42*c* and the second transparent electrodes 44*c* of a PDP according to the fifth preferred embodiment of the present invention are provided with a plurality of elliptic holes 59. In this case, triangular holes may be employed instead of the elliptic holes 59. Also, the holes may have conic, hexagonal or any other shape.

As shown in FIGS. 13 and 14, the first transparent electrodes 42*c* and the second transparent electrodes 44*c* are provided with the plurality of holes having various shapes, which reduces the areas of the electrodes and enhances the brightness to improve discharge efficiency. Also, small amount of discharge current is required to discharge to reduce power consumption.

As described above, the first transparent electrodes 42*c* and the second transparent electrodes 44*c* are formed in the direction of the long axis. The first transparent electrodes 42*c* and the second transparent electrodes 44*c* are provided with a pair of the wings A and A' each of which end extends to. The first transparent electrodes 42*c* and the second transparent electrodes 44*c* may further include the center wings B extending in the direction W that is the short axis direction at the position facing the barrier ribs.

In addition, the first transparent electrodes 42*c* and the second transparent electrodes 44*c* may be made in the form of a rectangular as large as possible so that the areas of the first transparent electrodes 42*c* and the second transparent electrodes 44*c* are substantially the same as the area of the discharge cells. In this case, the first transparent electrodes 42*c* and the second transparent electrodes 44*c* may be provided with a plurality of holes the shape of which can be hexagonal, circular or any other shape.

In the present invention, the first transparent electrodes 42*c* and the second transparent electrodes 44*c* may be made of ITO. The scan electrode lines 42*a*, the sustain electode lines 44*a*, the first projection electrodes 42*b* and the second projection electrodes 44*b* can be made of any one of copper (Cu), chrome (Cr) and silver (Ag).

Further, according to the plasma display panel of the present invention, sustain discharges occur in the direction of the long axis to enlarge discharge space. The areas of discharge electrodes are decreased to reduce the power consumption. Accordingly, the amount of the emitted visible rays increase to improve discharge efficiency.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel, comprising:

a plurality of barrier ribs formed on a first substrate;

a plurality of scan electrode lines and a plurality of sustain electrode lines formed on a second substrate in a long axis direction of the barrier ribs;

a plurality of first projection electrodes configured to alternately project in opposite directions and perpendicular to the plurality of scan electrode lines;

a plurality of second projection electrodes configured to alternately project from the plurality of sustain electrode lines and to face the plurality of first projection electrodes;

a plurality of first transparent electrodes positioned over adjacent discharge cells formed by the plurality of barrier ribs and perpendicular to the plurality of first projection electrodes;

a plurality of second transparent electrodes positioned over adjacent discharge cells formed by the plurality of barrier ribs and perpendicular to the plurality of second projection electrodes; and a plurality of address electrodes formed on the first substrate parallel to the plurality of first transparent electrodes and the plurality of second transparent electrodes wherein an area of each of the plurality of address electrodes is larger at a portion within the discharge cells than at a portion proximate the barrier ribs.

2. The plasma display panel according to claim 1, wherein each of the plurality of first transparent electrodes and each of the plurality of second transparent electrodes includes a wing formed at each end thereof in a direction of a short axis of the plurality of barrier ribs.

3. The plasma display panel according to claim 1, wherein each of the plurality of first transparent electrodes and each of the plurality of second transparent electrodes include:

a wing formed at each end thereof and extending in a short axis direction of the barrier ribs; and a center wing formed at a position facing the barrier ribs, and extending in the short axis direction of the plurality of barrier ribs.

4. The plasma display panel according to claim 1, wherein the plurality of first transparent electrodes and the plurality of second transparent electrodes are substantially rectangular and include a plurality of holes formed therein.

5. The plasma display panel according to claim 4, wherein the plurality of holes are rectangular or elliptical in shape.

6. The plasma display panel according to claim 1, wherein the plurality of first transparent electrodes and the plurality of second transparent electrodes are made of ITO.

7. The plasma display panel according to claim 1, wherein the scan electrode lines, the sustain electrode lines, the first projection electrodes and the second projection electrodes comprise a material selected from the group consisting of copper (Cu), chrome (Cr) and silver (Ag).

8. The plasma display panel according to claim 1, wherein the plurality of first projection electrodes and the plurality of second projection electrodes are formed along portions of the plurality of barrier ribs.

9. The plasma display panel according to claim 1, wherein the first substrate is positioned at a rear portion of the plasma display panel and the second substrate is positioned at a front portion of the plasma display panel.

10. The plasma display panel according to claim 1, wherein a cross section of the plurality of barrier ribs is substantially rectangular in shape, and wherein a space formed by adjacent barrier ribs is substantially rectangular in shape.

11. The plasma display panel according to claim 1, wherein the plurality of barrier ribs comprise a plurality of delta-type ribs.

12. A plasma display panel, comprising barrier ribs formed on first substrate;

scan electrode lines and sustain electrode lines formed on a second substrate in a long axis direction of the barrier ribs;

first projection electrodes configured to alternately project from the scan electrode lines in opposite directions and perpendicular to the scan electrode lines;

second projection electrodes configured to alternately project from the sustain electrode lines and to face the first projection electrodes;

first and second transparent electrodes configured to be respectively and perpendicularly connected to the first and second projection electrodes, wherein the first and second transparent electrodes are substantially rectangular in shape and configured to extend into adjacent discharge cells formed by the barrier ribs; and address electrodes formed on the first substrate parallel to the first transparent electrodes and the second transparent electrodes, wherein an area of each of the address electrodes is larger at a portion within the discharge cells than at a portion proximate the barrier ribs.

13. The plasma display panel according to claim 12, wherein the first transparent electrodes and the second transparent electrodes each comprises a plurality of holes.

14. The plasma display panel according to claim 13, wherein the plurality of holes are rectangular or elliptical in shape.

15. The plasma display panel according to claim 12, wherein the first projection electrodes and the second projection electrodes are formed along portions of the barrier ribs.

16. The plasma display panel according to claim 12, wherein the first substrate is positioned at a rear portion of the plasma display panel and the second substrate is positioned at a front portion of the plasma display panel.

17. The plasma display panel according to claim 12, wherein a cross section of the barrier ribs is substantially rectangular in shape, and wherein a space formed by adjacent barrier ribs is substantially rectangular in shape.

18. The plasma display panel according to claim 12, wherein the barrier ribs comprise a plurality of delta-type ribs.

19. A plasma display panel, comprising:

barrier ribs formed on a first substrate;

scan electrode lines and sustain electrode lines formed on a second substrate in a long axis direction of the barrier ribs;

first projection electrodes configured to alternately project from the scan electrode lines in opposite directions and perpendicular to the scan electrode lines;

second projection electrodes configured to alternately project from the sustain electrode lines and to face the first projection electrodes;

first and second transparent electrodes configured to be respectively and perpendicularly connected to the first and second projection electrodes, wherein each of the first and second transparent electrodes comprises a pair of wings configured to extend in a short axis direction of the barrier ribs at ends thereof, and to extend into adjacent discharge cells formed by the barrier ribs; and address electrodes formed on the first substrate in parallel with the first transparent electrodes and the second transparent electrodes, wherein an area of the address electrode is larger at a portion within the discharge cells than at a portion proximate the barrier ribs.

20. The plasma display panel according to claim 19, wherein the first projection electrodes and the second projection electrodes are formed along a portion of the barrier ribs.

21. The plasma display panel according to claim 19, wherein the first substrate is positioned at a rear portion of the plasma display panel and the second substrate is positioned at a front portion of the plasma display panel.

22. A plasma display panel, comprising:

barrier ribs formed on a first substrate;

scan electrode lines and sustain electrode lines formed on a second substrate in a long axis direction of the barrier ribs;

first projection electrodes configured to alternately project from the scan electrode lines in opposite directions and perpendicular to the scan electrode lines;

second projection electrodes configured to alternately project from the sustain electrode lines and to face the first projection electrodes;

first and second transparent electrodes configured to be respectively and perpendicularly connected to the first and second projection electrodes, wherein each of the first and second transparent electrodes includes a pair of wings configured to extend from the ends thereof in a short axis direction of the barrier ribs, and a center wing configured to extend in the short axis direction of the barrier ribs, and extend to adjacent discharge cells formed by the barrier ribs; and address electrodes formed on the first substrate in parallel with the first transparent electrodes and the second transparent electrodes, wherein an area of the address electrodes is larger at a portion within the discharge cells than at a portion proximate the barrier ribs.

23. The plasma display panel according to claim 22, wherein the first projection electrodes and the second projection electrodes are formed along the barrier ribs.

24. The plasma display panel according to claim 22, wherein the first substrate is positioned at a rear portion of the plasma display panel and the second substrate is positioned at a front portion of the plasma display panel.

25. The plasma display panel according to claim 22, wherein a cross section of the barrier ribs is substantially rectangular in shape, and wherein a space formed by adjacent barrier ribs is substantially rectangular in shape.

26. The plasma display panel according to claim 22, wherein the barrier ribs comprise a plurality of delta-type ribs.

27. A plasma display panel, comprising:

a plurality of barrier ribs formed on a first substrate and configured to form a plurality of discharge cells;

a plurality of scan electrode lines and a plurality of sustain electrode lines formed on a second substrate;

a plurality of first projection electrodes formed perpendicular to the plurality of scan electrodes;

a plurality of second projection electrodes formed perpendicular to the plurality of certain electrodes and parallel to the plurality of first projection electrodes; and a plurality of address electrodes formed on the first substrate and parallel to the plurality of first transparent electrodes and the plurality of second transparent electrodes.

28. The plasma display panel according to claim 27, wherein the plurality of discharge cells are substantially rectangular in shape.

29. The plasma display panel according to claim 28, wherein the plurality of scan electrode lines and the plurality of sustain electrode lines are formed in a long axis direction of the plurality of rectangular discharge cells.

30. The plasma display panel according to claim 27, wherein the plurality of first projection electrodes are configured to alternately project in opposite directions perpendicular to the plurality of scan electrode lines.

31. The plasma display panel according to claim 27, wherein the plurality of second projection electrodes are configured to alternately project in opposite directions parallel to the plurality of first projection electrodes.

32. The plasma display panel according to claim 27, wherein an area of each of the plurality of address electrodes is larger at a portion within the plurality of discharge cells than at a portion proximate the plurality of barrier ribs.

33. The plasma display panel of claim 27, further comprising:

a plurality of first transparent electrodes positioned above adjacent discharge cells and perpendicular to the plurality of first projection electrodes; and a plurality of second transparent electrodes positioned above adjacent discharge cells and perpendicular to the plurality of second projection electrodes.

34. The plasma display panel according to claim 33, wherein each of the plurality of first transparent electrodes and each of the plurality of second transparent electrodes comprises a wing formed at each end thereof and in a short axis direction of the plurality of discharge cells.

35. The plasma display panel according to claim 34, wherein each of the plurality of first transparent electrodes and each of the plurality of second transparent electrodes further comprises a center wing formed in a short axis direction of the plurality of discharge cells.

36. The plasma display panel according to claim 27, wherein the plurality of barrier ribs comprise a plurality of delta-type barrier ribs, and wherein the plurality of discharge cells formed by the plurality of barrier ribs comprise a plurality of delta-type discharge cells.

* * * * *